US008554127B2

(12) United States Patent
Yoshida et al.

(10) Patent No.: US 8,554,127 B2
(45) Date of Patent: Oct. 8, 2013

(54) METHOD OF CORRECTING CURL OF SHEET AND RECORDING APPARATUS

(75) Inventors: Masahito Yoshida, Shiki (JP); Yasuhiko Ikeda, Sagamihara (JP); Kenji Shigeno, Yokohama (JP); Koichiro Kawaguchi, Yokohama (JP); Toshiki Takeuchi, Yokohama (JP); Masato Izumi, Kawasaki (JP); Kengo Nieda, Kawasaki (JP); Ryosuke Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/617,476

(22) Filed: Sep. 14, 2012

(65) Prior Publication Data

US 2013/0010043 A1 Jan. 10, 2013

Related U.S. Application Data

(63) Continuation of application No. 12/911,430, filed on Oct. 25, 2010, now Pat. No. 8,295,758.

(30) Foreign Application Priority Data

Oct. 27, 2009 (JP) ..... 2009-246556

(51) Int. Cl.
*G03G 15/00* (2006.01)
*B65H 5/02* (2006.01)

(52) U.S. Cl.
USPC ..... 399/406; 271/272; 271/270; 347/104

(58) Field of Classification Search
USPC ..... 399/406; 271/272, 270, 264; 347/101, 347/104
See application file for complete search history.

(56) References Cited

U.S. PATENT DOCUMENTS

| | | | |
|---|---|---|---|
| 4,627,718 | A | 12/1986 | Wyer |
| 5,183,454 | A | 2/1993 | Kurosawa |
| 5,202,737 | A | 4/1993 | Hollar |
| 7,954,939 | B2 | 6/2011 | Yamamoto et al. |
| 2009/0003912 | A1 | 1/2009 | Nagasaki |
| 2009/0257801 | A1 | 10/2009 | Miyoshi |

FOREIGN PATENT DOCUMENTS

| | | | |
|---|---|---|---|
| CN | 101497408 | A | 8/2009 |
| EP | 2085347 | A2 | 8/2009 |
| JP | 6064820 | A | 3/1994 |
| JP | 08-026564 | A | 1/1996 |
| JP | 2071614 | C | 7/1996 |

*Primary Examiner* — Kaitlin Joerger
(74) *Attorney, Agent, or Firm* — Canon USA Inc. IP Division

(57) ABSTRACT

In a first step, a sheet is conveyed in a direction, whereby a leading end portion of the sheet is fed to a position between a decurl roller and a decurl pinch roller, which are in positions spaced apart from each other. In a second step, the leading end portion of the sheet is curved and held by causing the decurl pinch roller to come close to or press against the decurl roller. In a third step, the leading end portion of the sheet is withdrawn from between the decurl roller and the decurl pinch roller by conveying the sheet in a direction opposed to the conveying direction. After executing the first to third steps, the sheet is conveyed in the conveying direction through the first step while the sheet is curved by the decurl roller.

8 Claims, 7 Drawing Sheets

METHOD OF CORRECTING CURL OF SHEET AND RECORDING APPARATUS

CROSS REFERENCE TO RELATED APPLICATIONS

The present application is a Continuation of U.S. patent application Ser. No. 12/911,430 filed Oct. 25, 2010, which claims priority from Japanese Patent Application No. 2009-246556 filed Oct. 27, 2009, the entire contents of each of which are hereby incorporated by reference.

BACKGROUND OF THE INVENTION

1. Field of the Invention

The present invention relates to a method of correcting curl of a sheet and a recording apparatus for carrying out the method of correcting curl of the sheet.

2. Description of the Related Art

In recording apparatuses such as a printer, a facsimile, and a copying machine, an image is recorded on a sheet (a recording medium) by a recording head in accordance with image information. The recording apparatuses can be classified into various types depending on a recording method performed by the recording head. One type of the recording apparatuses is, e.g., an ink jet recording apparatus in which recording is performed by discharging ink to the recording medium through discharge ports of the recording head. In the ink jet recording apparatus, recording is performed by causing ink droplets to fly to a recording surface. Therefore, if the recording medium is too close to the recording head, the recording medium and the recording head would come into contact with each other, thus generating an ink stain and smear. If they are far apart from each other, the ink droplets would not land on correct positions on the recording surface. To cope with those drawbacks, it is required to properly manage the distance between the recording head and the recording medium (hereinafter also referred to as the "head-to-paper distance"). In order to maintain the proper head-to-paper distance, it is also often required to ensure flatness of the recording medium.

One proposal for maintaining the proper head-to-paper distance is to convey a recording medium to a recording section after correcting curl of the recording medium in advance. The curl is generally corrected by curving the recording medium in a direction reversal to the curling direction of the recording medium. For example, the curl is corrected by a method of pressing a decurl roller against the recording medium, which is conveyed in a state gripped by a pair of paper feed rollers and a pair of conveying rollers, such that a curvature is given to the recording medium in the direction reversed from the curling direction between both the roller pairs. However, the known curl correction method has the issue of a curvature to a leading end portion of the recording medium and the curl is apt to remain in the leading end portion of the recording medium.

Further, the leading end portion of the recording medium tends to cause particular deformations, such as folding and skewing, and a curl condition is apt to disorder in the leading end portion of the recording medium. From the viewpoint of managing the head-to-paper distance, therefore, the leading end portion of the recording medium requires dedicated treatment differing from that required in the other portion of the recording medium. For example, when the recording medium is conveyed to the recording section, the recording medium is desirably curled downward so that the leading edge of the recording medium will not contact the recording head. On the other hand, if the recording medium is entirely curled downward, the recording surface is caused to convex toward the recording head and is more likely to contact the recording head. Further, in some cases, dedicated curl correction is required for only the leading end portion of the recording medium such that the leading end portion can be easily led into the nip between a pair of conveying rollers in the recording section.

In general, the curl of the recording medium is corrected by curving the recording medium in the reversed direction while tension is applied to the recording medium. However, because the leading end portion of the recording medium is gripped after being passed through the nip between a pair of gripping rollers, it is difficult to strongly curve the leading end portion of the recording medium and to correct the curl in the leading end portion. For that reason, using a special curl correction unit adapted for the leading end portion of the recording medium is proposed. For example, Japanese Patent Laid-Open No. 08-026564 proposes a method of temporarily guiding only the leading end portion of the recording medium to a separate mechanism unit and curving the leading end portion by using a special mechanism. Further, Japanese Patent Laid-Open No. 2006-168948 proposes a method of enhancing the curving of the recording medium to correct the curl by repeating operations of feeding the recording medium forward and backward plural times.

However, the method proposed in Japanese Patent Laid-Open No. 08-026564 requires addition of the special mechanism to correct the curl in the leading end portion of the recording medium, and has the problem that an apparatus is complicated and its size tends to increase. Further, with the method proposed in Japanese Patent Laid-Open No. 2006-168948, curl correction power is adjusted by curving the leading end portion of the recording medium plural times, but problems arise in that there is a limitation in curving the leading end portion to give it a curvature, the operation time is prolonged, and the curving direction is restricted.

SUMMARY OF THE INVENTION

In view of the problems described above, the present invention provides a method of correcting curl of a sheet and a recording apparatus, which can correct curl in a leading end portion of the sheet in a dedicated manner without reducing performance in conveying the sheet.

According to the present invention, there is provided a method of correcting curl of a sheet, the method including a first step of conveying the sheet in a conveying direction, thereby feeding a leading end portion of the sheet to a position between a decurl roller and a decurl pinch roller, which are in positions spaced apart from each other, a second step of curving and holding the leading end portion of the sheet by causing the decurl pinch roller to come close to or press against the decurl roller, a third step of withdrawing the leading end portion of the sheet from between the decurl roller and the decurl pinch roller by conveying the sheet in a direction opposed to the conveying direction, and a step of, after executing the first to third steps, conveying the sheet in the conveying direction.

With the present invention, the method of correcting curl of the sheet and the recording apparatus are provided which can correct the curl in the leading end portion of the sheet in a dedicated manner without reducing the performance in conveying the sheet.

Further features of the present invention will become apparent from the following description of exemplary embodiments with reference to the attached drawings.

BRIEF DESCRIPTION OF THE DRAWINGS

FIG. 1A is a vertical sectional view when a recording medium (a sheet) is conveyed parallel, and FIG. 1B is a vertical sectional view when the recording medium is conveyed obliquely downward.

FIG. 5A is a vertical sectional view when a leading end portion of the recording medium is conveyed to a curl correction position, FIG. 5B is a vertical sectional view when the leading end portion of the recording medium is curved to correct curl in the leading end portion, and FIG. 5C is a vertical sectional view when curl of the entire recording medium is corrected.

FIG. 7A is a vertical sectional view when the leading end portion of the recording medium is conveyed to a position where the curl correction is performed in a direction opposite that in the case of FIG. 5B, and FIG. 7B is a vertical sectional view when curl is corrected by curving the leading end portion of the recording medium in the direction opposite that in the case of FIG. 5B.

DESCRIPTION OF THE EMBODIMENTS

Figure 1A:
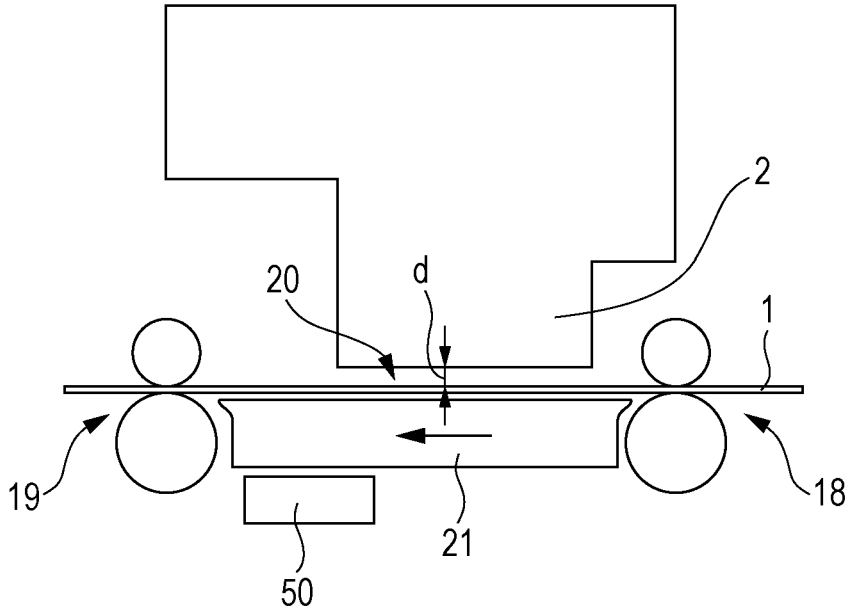
FIGS. 1A and 1B illustrate a recording apparatus according to one embodiment; specifically.
Figure 1B:
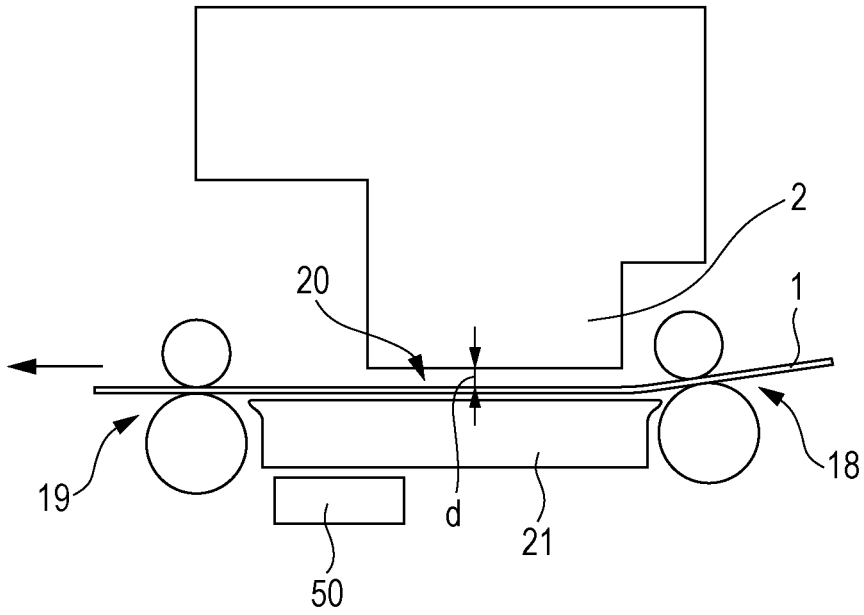

An embodiment of the present invention will be described in detail below with reference to the drawings. Be it noted that, in all the drawings, the same characters denote the same or corresponding components. FIGS. 1A and 1B illustrate a recording apparatus suitable for carrying out a method of correcting curl of a sheet. More specifically, FIG. 1A is a vertical sectional view when the recording medium is conveyed parallel, and FIG. 1B is a vertical sectional view when the recording medium is conveyed obliquely downward. The recording apparatus illustrated in FIGS. 1A and 1B is an ink jet recording apparatus in which an image is recorded by discharging ink to a recording medium(a sheet) 1 through ejection ports of a recording head 2 in accordance with image information.

In the ink jet recording apparatus, the recording medium 1 in the form of a sheet is conveyed to a recording section 20 while it is gripped by a pair of recording-section conveying rollers 18. Ink is discharged from the recording head 2 to the recording medium 1 supported on a platen 21 such that an image is recorded on the recording medium 1. The recording medium 1 including the image recorded thereon is ejected externally of a main body of the recording apparatus through a pair of paper-ejection conveying rollers 19. The recording head 2 may be of the serial type that main scanning is performed in a direction crossing the direction in which the recording medium is conveyed, or the line type that the recording head has a length covering the entire width of the recording medium and an image is recorded one-line by one-line at a time. Between the recording head 2 and the recording medium 1, there is a predetermined gap (head-to-paper distance) d through which ink droplets are caused to fly.

In FIG. 1A, a parallel state of the recording medium 1 is held by gripping the recording medium 1 at respective nips of the conveying roller pairs 18 and 19 on the upstream and downstream sides, and by applying tension to the recording medium. In such a case, the platen 21 can be dispensed with. On the other hand, in FIG. 1B, the nip of the recording-section conveying roller pair 18 is set to be inclined downward, and a parallel state of the recording medium 1 is held by conveying the recording medium 1 to follow an upper surface of the platen 21. The recording medium 1 may be a cut sheet having a certain size or a long sheet of roll paper. The recording medium 1 can be made of various materials, including a plastic sheet, printing paper, a piece of cloth, etc., in addition to ordinary paper so long as an image can be recorded on the material.

The recording apparatus includes a control unit 50, which is constituted by a controller including a CPU, a memory, an I/O circuit, and so on. The control unit 50 controls operations of a drive motor and other various devices in accordance with control programs that are previously stored in the internal memory. As a result, feeding and conveyance of the recording medium are controlled, and the recording head 2 is controlled in accordance with image information (such as recording signals or recording data), whereby an image is successively recorded on the recording medium 1. Further, the control unit 50 controls not only the operation of a curl correction mechanism 30 described later, but also respective operations of various mechanisms and timings of those operations.

Figure 2:
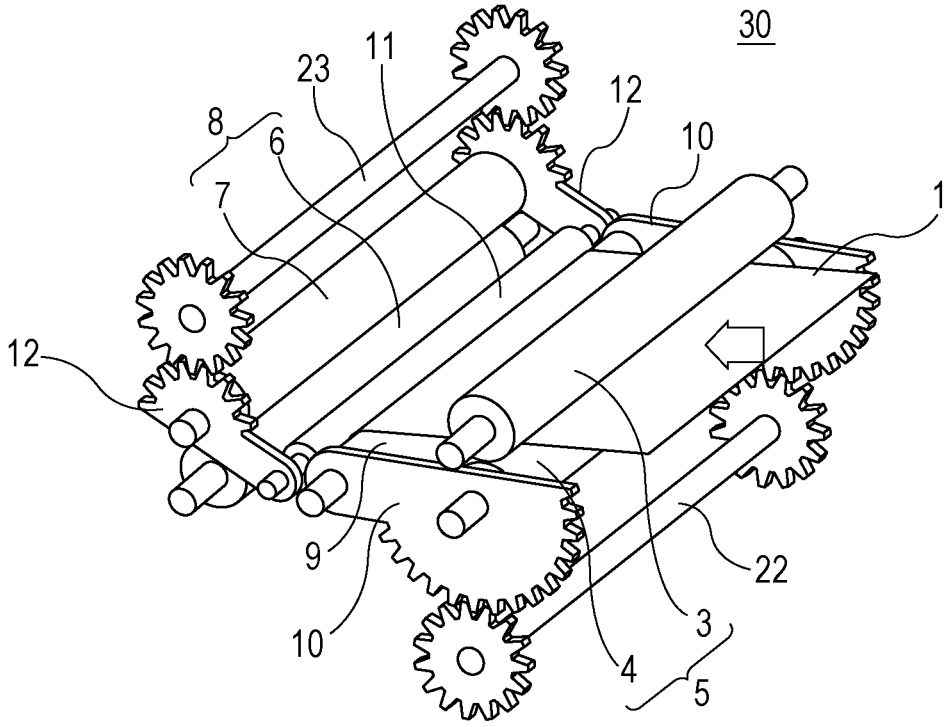
FIG. 2 is a perspective view of a curl correction mechanism according to one embodiment.

FIG. 2 is a perspective view of the curl correction mechanism 30 for carrying out the method of correcting curl of the recording medium according to the embodiment of the present invention. A pair of paper feed rollers 5 is constituted by a paper-feed driving roller 3 that is rotated by a driving source 13 (FIG. 3), and a paper-feed driven roller 4 that is frictionally rotated while being pressed by the paper-feed driving roller 3. The recording medium 1 is fed from a paper supply source (not shown) through the nip between the pair of paper feed rollers 5. A pair of conveying rollers 8 is constituted by a conveyance driving roller 6 that is rotated by a driving source 14 (FIG. 3), and a conveyance driven roller 7 that is frictionally rotated while being pressed by the conveyance driving roller 6. Between the roller pairs 5 and 8, a decurl roller 9 and a decurl pinch roller 11 are disposed to correct the curl of the recording medium 1. The decurl roller 9 serves as a roller for curving the recording medium to give it a curvature in a direction opposite to the curl, and the decurl pinch roller 11 serves as a roller for pressing the recording medium 1 against the decurl roller 9.

The decurl roller 9 is rotatably mounted at its opposite ends to respective fore ends of decurl arms 10. The decurl arms 10 can be each rotated (swung) by a driving source 15 (FIG. 3) about a fulcrum (axis) of the paper-feed driven roller 4. The position of the decurl roller 9 can be changed by controlling rotational positions of the decurl arms 10 depending on curl correction conditions. The decurl pinch roller 11 is rotatably mounted at its opposite ends to respective fore ends of decurl pinch arms 12. The decurl pinch arms 12 can be each rotated by a driving source 16 (FIG. 3) about a fulcrum (axis) of the conveyance driven roller 7. A winding state (such as a winding angle) of the recording medium around the decurl roller 9 can be changed by controlling positions of the decurl pinch arms 12 to change a position of the decurl pinch roller 11 depending on the curl correction conditions. While the pair of recording-section conveying roller 18 and the pair of conveying rollers 8 are constituted as separate roller pairs in this embodiment, the pair of conveying rollers 8 may also serve as the pair of recording-section conveying roller 18 depending on the construction of the recording apparatus.

Figure 3:
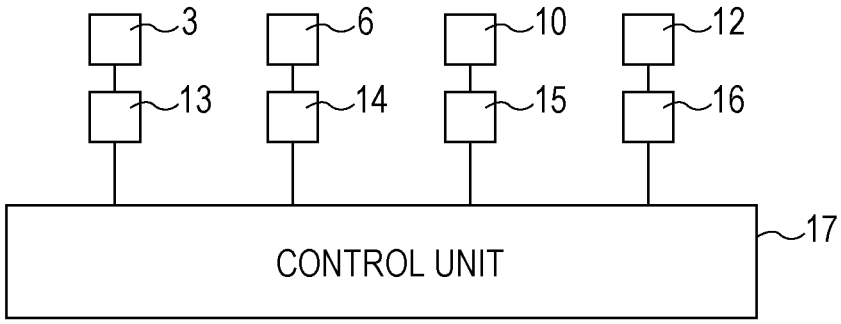
FIG. 3 is a block diagram of a control unit for the curl correction mechanism.

FIG. 3 is a block diagram of a control unit 17 for the curl correction mechanism 30. The driving source 13 for the paper-feed driving roller 3, the driving source 14 for the conveyance driving roller 6, the driving source 15 for the decurl arms 10, and the driving source 16 for the decurl pinch arms 12 are controlled by the control unit 17 independently of one another. The decurl arms 10 and the decurl pinch arms 12 are controlled to be moved to respective desired positions through open control that is performed after their initial positions have been determined.

Figure 4:
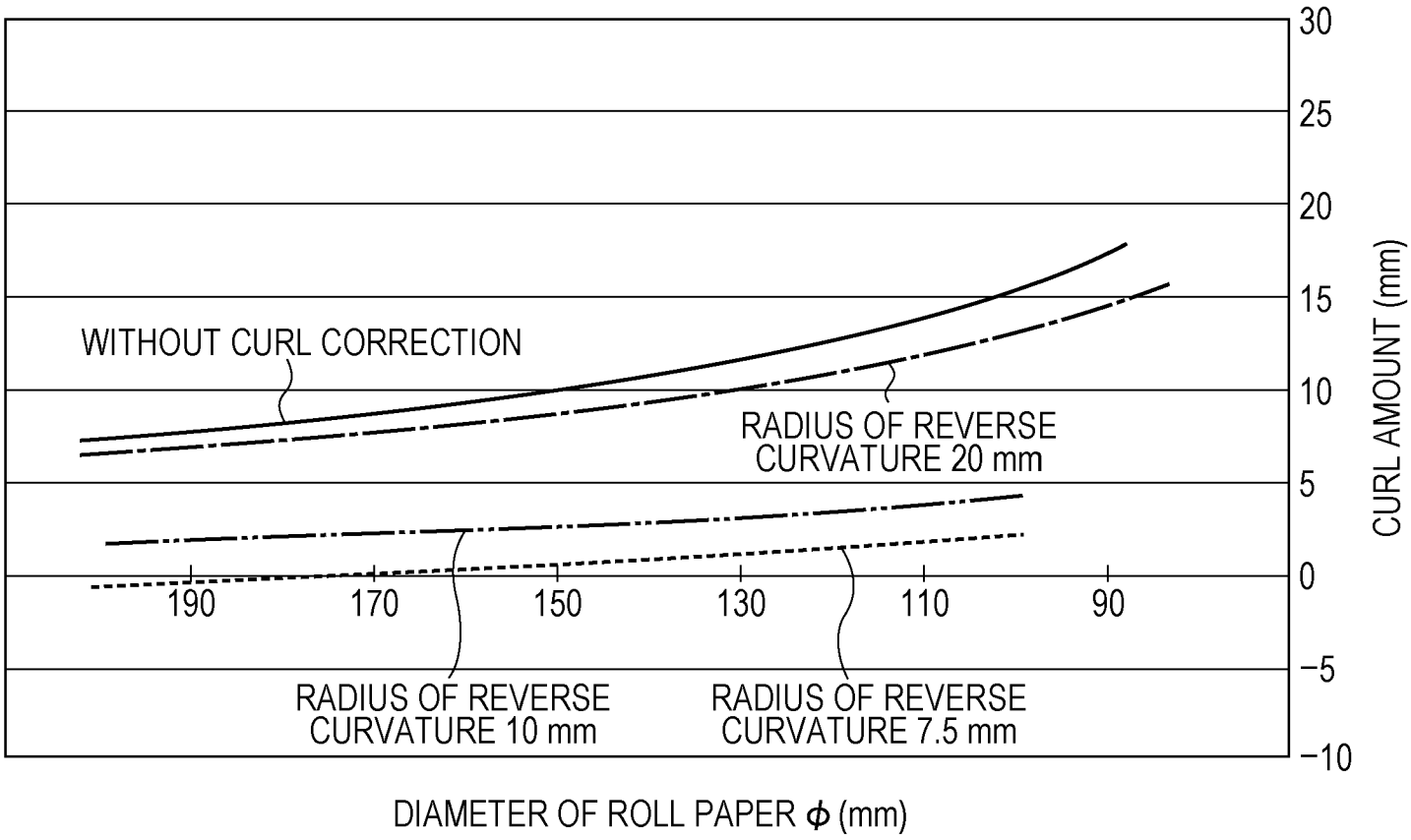
FIG. 4 is a graph illustrating the relationship between an extent of curving (radius of curvature) applied to the recording medium in a direction opposite the curling direction and an amount of remaining curl.

FIG. 4 is a graph illustrating the results of tests determining an extent of curving (radius of curvature) that is to be applied to the recording medium in the reversed direction when the curl correction is performed. The graph of FIG. 4 indicates the results of measuring the curl amounts when roll paper having basis weight of about 280 ($g/m^2$) and a width of 125 mm is used as a sample of the recording medium 1 and the curled recording medium is curved to successively give it different radiuses of curvatures. The measurement of the curl amount is conducted by cutting the sample to a length of 120 mm, and by measuring a floating at each of four corners when the sample is placed on a flat surface in such a state that the four corners will rise from the flat surface when the sample is curled after decurling. In FIG. 4, "+" indicates the case where the recording medium is curled after the decurling in a direction opposite that of the original curl, and "−" indicates the case where the recording medium is curled after the decurling in the same direction as that of the original curl.

In FIG. 4, the horizontal axis represents the winding diameter of the roll paper as the sample, and the vertical axis represents the measured results of the curl amounts. Data curves in FIG. 4 represent not only the curl amount measured when the curl correction is not performed, but also respective curl amounts measured when the radius of curvature applied by curving the recording medium in the reversed direction to correct the curl is set to 7.5 mm, 10 mm, and 20 mm. As seen from the graph of FIG. 4, the smaller the radius of curvature applied by curving the recording medium in the reversed direction, the greater is the effect of decurling in the reversed direction. Further, in the tests of FIG. 4, the radius of curvature applied by curving the recording medium in the reversed direction is adjusted by changing a condition of pressing the recording medium.

Figure 5A:
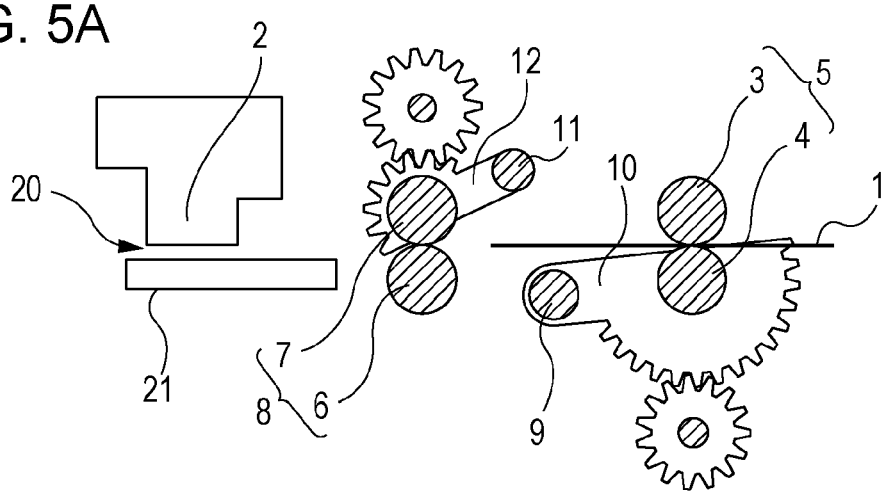
FIGS. 5A, 5B and 5C illustrate the curl correction mechanism according to one embodiment; specifically.
Figure 5B:
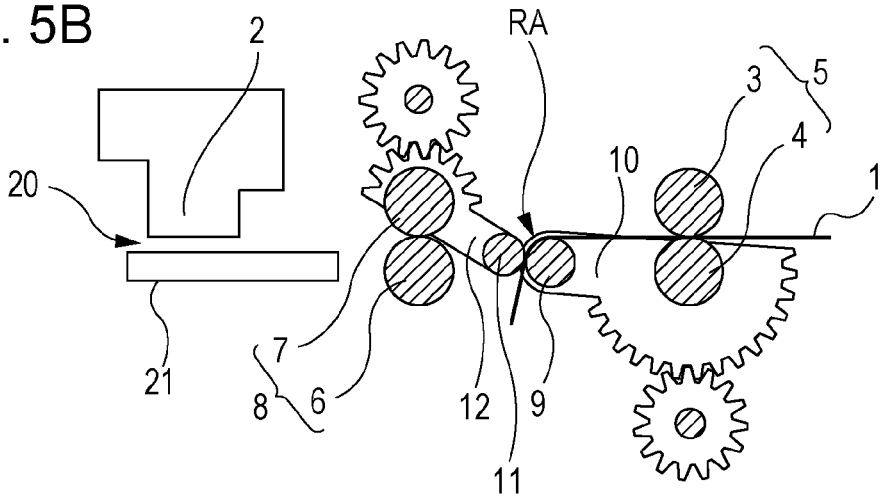
Figure 5C:
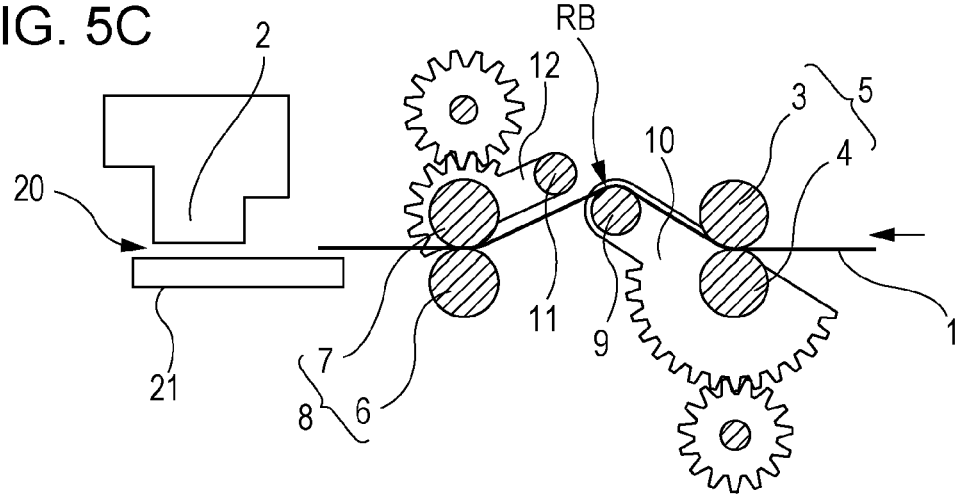

FIGS. 5A, 5B and 5C are vertical sectional views illustrating the operation of the curl correction mechanism 30 in FIG. 2. More specifically, FIG. 5A is a vertical sectional view when a leading end portion of the recording medium 1 is conveyed to a curl correction position. FIG. 5B is a vertical sectional view when the leading end portion of the recording medium 1 is curved to correct the curl in the leading end portion. FIG. 5C is a vertical sectional view when the curl of the entire recording medium is corrected. After the recording medium 1 has been fed out from the paper supply source, the leading end portion of the recording medium 1 is gripped between the pair of paper feed rollers 5 and is conveyed toward the pair of conveying rollers 8 by rotating the paper-feed driving roller 3 forward. At that time, as illustrated in FIG. 5A, the decurl roller 9 and the decurl pinch roller 11 are spaced from each other such that they are retracted from an intended path along which the leading end of the recording medium 1 is to be conveyed. The recording medium 1 is temporarily stopped upon being conveyed to the position illustrated in FIG. 5A. Then, as illustrated in FIG. 5B, the decurl roller 9 is moved to a predetermined position and the decurl pinch roller 11 is moved to a position where the recording medium can be gripped between the decurl roller 9 and the decurl pinch roller 11, while the recording medium 1 is kept gripped between the pair of paper feed rollers 5. As a result, the leading end portion of the recording medium 1 is wound over the decurl roller 9 in a state curved following the circumference of the decurl roller 9. Stated another way, the curl correction is performed on the leading end portion of the recording medium 1 in the state of FIG. 5B.

Then, the recording medium 1 is withdrawn from the decurl roller 9 by rotating the paper-feed driving roller 3 backward (i.e., a direction opposed to the direction for making recording), while the leading end portion of the curved recording medium 1 is kept gripped between the decurl roller 9 and the decurl pinch roller 11. At that time, the decurl roller 9 and the decurl pinch roller 11 are positioned as illustrated in FIG. 5B. However, the recording medium 1 is conveyed in the backward direction (returning direction) until the leading end of the recording medium 1 comes to a predetermined position between the decurl roller 9 and the pair of paper feed rollers 5 or to the upstream side of the pair of paper feed rollers 5.

Then, the recording medium 1 is conveyed toward the pair of conveying rollers 8 again by rotating the paper-feed driving roller 3 forward in the direction for making recording, while the recording medium 1 is kept gripped between the pair of paper feed rollers 5, or after the recording medium 1 has been gripped between the pair of paper feed rollers 5. At that time, the decurl roller 9 and the decurl pinch roller 11 are in the retracted positions as in the state of FIG. 5A such that the leading end of the recording medium 1 is conveyed to advance along a similar path to the intended conveyance path described above. Thus, the recording medium of which leading end portion has been subjected to the curl correction, as illustrated in FIG. 5B, is temporarily withdrawn by conveying it backward, and thereafter the recording medium is conveyed again to the position illustrated in FIG. 5A. Be it noted that the above-described operations of correcting the curl in the leading end portion of the recording medium and withdrawing the recording medium may be repeated plural times in consideration of how the leading end portion of the recording medium is curled and how the curl is to be corrected.

Then, the recording medium 1 is further conveyed after passing the state of FIG. 5A, and it is stopped when the leading end portion of the recording medium 1 is led to and gripped by the nip between the pair of conveying rollers 8. In other words, the recording medium 1 is brought into a state gripped by both the pair of paper feed rollers 5 and the pair of conveying rollers 8. In such a state, the paper-feed driving roller 3 (and the conveyance driving roller 6 as required) is rotated forward through a predetermined amount to allow predetermined slack in the recording medium 1. Then, after moving only the decurl roller 9 to a predetermined position suitable for curving the recording medium 1 as illustrated in FIG. 5C, the paper-feed driving roller 3 and the conveyance driving roller 6 are rotated forward to convey the recording medium 1 toward the recording position 20. By bringing the recording medium into such a conveying state, the curl correction can be performed while applying a curvature to the other entire portion of the recording medium 1 subsequent to the leading end portion. FIG. 5C illustrates the state where the curl correction is performed on the other entire portion of the recording medium 1 subsequent to the leading end portion. An actual position of the decurl roller 9 is adjusted depending on the curl amount to be corrected and other conditions. With the curl correction mechanism 30 thus constructed, the extent of curving applied by the decurl roller 9 can be easily and accurately changed between the leading end portion of the recording medium 1 and the other portion of the recording medium 1 subsequent to the leading end portion.

According to the curl correction mechanism 30 described above, since the curl correction can be performed separately on the leading end portion of the recording medium 1 by applying a different extent of curving from that applied to the other subsequent portion thereof, respective curls in the leading end portion of the recording medium and the other subsequent portion can be effectively and properly corrected without reducing the performance in conveying the recording medium. In the curl correction mechanism 30, the extent of the curl correction can be adjusted, for example, by changing the hardness of the decurl pinch roller 11. Alternatively, the extent of the curl correction can also be adjusted by changing the number and the position of the decurl pinch roller 11, for example, by arranging a plurality of decurl pinch rollers 11 to press the recording medium against the circumferential surface of the decurl roller 9.

In the state of FIG. 5B, by stopping the decurl pinch roller 11 near the decurl roller 9, the recording medium can be curved to be given with a reversed curvature, represented by a circular arc RA, at a desired radius larger than that of the decurl roller 9. Hence, the extent of the curl correction can be further adjusted depending on the stopped position of the decurl pinch roller 11. In the state of FIG. 5C, after adjusting respective amounts through which the recording medium is initially conveyed by the pair of paper feed rollers 5 and the pair of conveying rollers 8, the recording medium is continuously conveyed in a state where the decurl roller 9 is moved to the curl correction position. Hence, the recording medium can be conveyed while it is curved to be given with a reversed curvature, represented by a circular arc RB, at a desired radius larger than that of the decurl roller 9.

Figure 6:
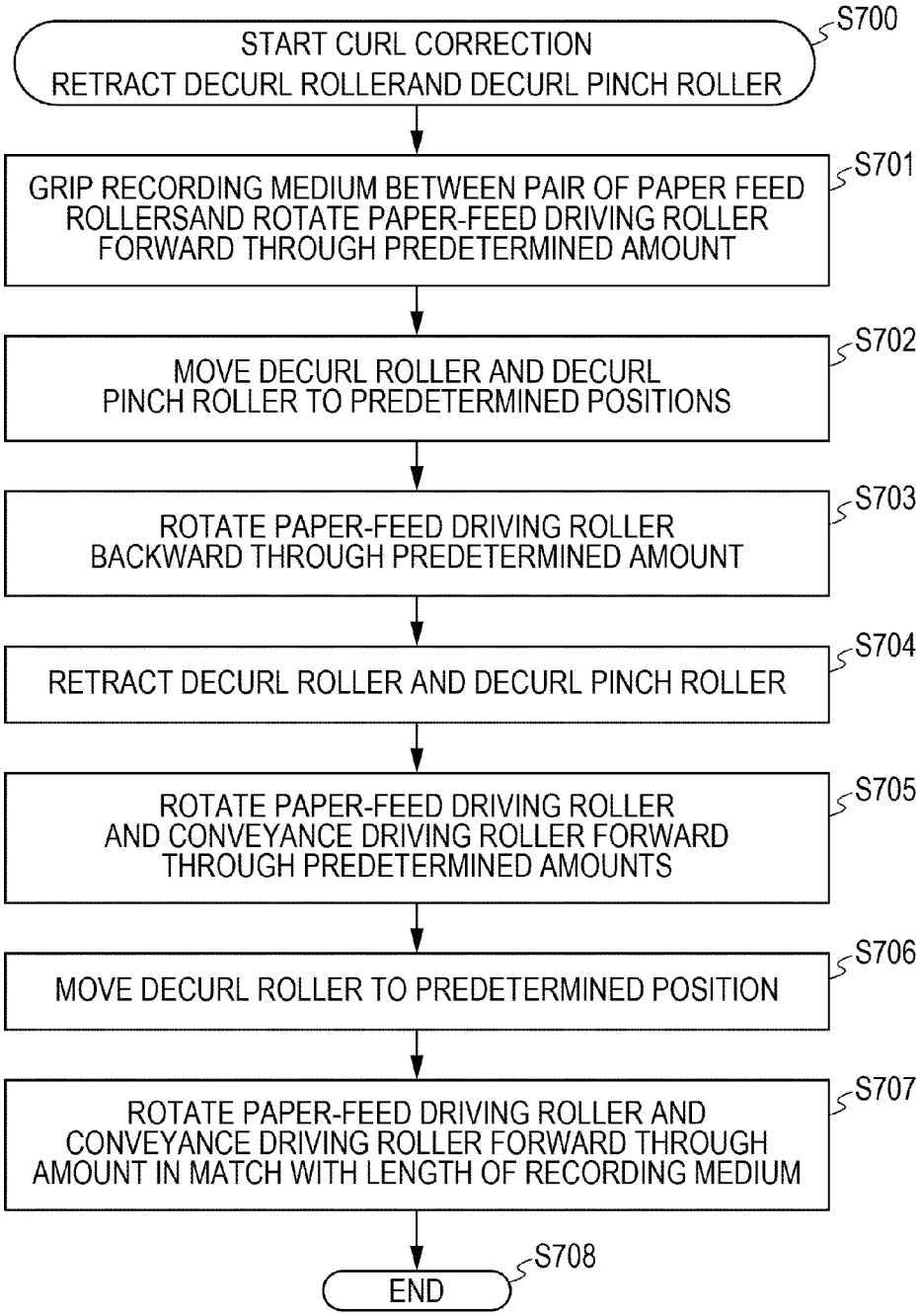
FIG. 6 is a flowchart of the operation of a method of correcting curl of the recording medium according to one embodiment.

FIG. 6 is a flowchart of the operation sequence of the method of correcting curl of the recording medium according to one embodiment. Referring to FIG. 6, in step S700, the curl correction is started in the state where the decurl roller 9 and the decurl pinch roller 11 are spaced from each other to be retracted from the intended conveyance path of the leading end of the recording medium 1. In step S701, the recording medium 1 is gripped between the pair of paper feed rollers 5 and is conveyed toward the pair of conveying rollers 8 up to the predetermined position by rotating the paper-feed driving roller 3 forward. FIG. 5A illustrates the state of the curl correction mechanism 30 at that time. The recording medium 1 is conveyed between the decurl roller 9 and the decurl pinch roller 11 and is stopped when the leading end of the recording medium 1 has reached a position ahead the pair of conveying rollers 8 by the predetermined distance. Thus, a first step of conveying the recording medium 1 in the direction for making recording, thereby feeding the leading end portion of the recording medium 1 to a position between the decurl roller 9 and the decurl pinch roller 11, which are in the spaced positions (retracted positions), is executed in step S701.

Next, in step S702, the decurl roller 9 is moved to the predetermined position and the decurl pinch roller 11 is moved to the position where it is pressed against the decurl roller 9, thereby gripping the recording medium 1 therebetween in the state where the recording medium 1 is curved along the circumferential surface of the decurl roller 9. The state of the curl correction mechanism 30 in step S702 is as illustrated in FIG. 5B, and the actual roller position is adjusted depending on the curl amount to be corrected. Thus, a second step of curving and holding the leading end portion of the recording medium 1 by causing the decurl pinch roller 11 to come close to or press against the decurl roller 9 is executed in step S702.

Next, in step S703, the recording medium 1 is withdrawn from the decurl roller 9 by rotating the paper-feed driving roller 3 backward while the recording medium 1 is kept gripped between the decurl roller 9 and the decurl pinch roller 11 in the curved state. The respective positions of the decurl roller 9 and the decurl pinch roller 11 at that time are as illustrated in FIG. 5B. In addition, the recording medium 1 is conveyed in the backward direction until the leading end of the recording medium 1 comes to the predetermined position between the decurl roller 9 and the pair of paper feed rollers 5 or to the upstream side of the pair of paper feed rollers 5. Thus, a third step of withdrawing the leading end portion of the recording medium 1 from between the decurl roller 9 and the decurl pinch roller 11 by conveying the recording medium 1 in the direction opposed to that for making recording is executed in step S703.

Next, in step S704, the recording medium 1 is conveyed toward the pair of conveying rollers 8 by rotating the paper-feed driving roller 3 forward, while the recording medium 1 is kept gripped between the pair of paper feed rollers 5, or after the recording medium 1 has been gripped between the pair of paper feed rollers 5. At that time, the decurl roller 9 and the decurl pinch roller 11 are in the retracted positions similar to those in the state of FIG. 5A such that the leading end of the recording medium 1 is conveyed along the intended conveyance path as in step S701. In step S705, the recording medium 1 is further conveyed after passing the state of FIG. 5A, and it is stopped when the leading end portion of the recording medium 1 is led to and gripped by the nip between the pair of conveying rollers 8. Thus, the recording medium 1 is brought into the state gripped by both the pair of paper feed rollers 5 and the pair of conveying rollers 8.

Next, in step S705, the paper-feed driving roller 3 and the conveyance driving roller 6 are rotated forward through predetermined amounts to allow predetermined slack in the recording medium 1. Next, in step S706, only the decurl roller 9 is moved to the predetermined position suitable for curving the recording medium 1, as illustrated in FIG. 5C. Next, in step S707, the paper-feed driving roller 3 and the conveyance driving roller 6 are rotated forward to convey the recording medium 1 in the direction for recording, whereby the curl correction of the recording medium 1 can be performed while applying a curvature to the other portion of the recording medium 1 subsequent to the leading end portion. FIG. 5C illustrates the state where the curl correction is performed on the recording medium 1 in step S707. The actual position of the decurl roller 9 during the curl correction is adjusted to vary within a predetermined range depending on the curl amount to be corrected. Thus, after executing the above-described first to third steps, a curl correction process of conveying the recording medium 1 in the direction for recording while curving the recording medium 1 by the decurl roller 9 is executed in steps S705 to S707 through the above-described first step. At that time, the recording medium 1 is curved by using only the decurl roller 9. In other words, the curl correction process executed here is a process of correcting the curl in the other entire portion of the recording medium 1 subsequent to the leading end portion.

The curl correction operation in FIG. 6 employs a sequence of correcting the curl in the leading end portion of the recording medium 1 once in steps from S701 (first step) to S703 (third step), and then correcting the curl in the other entire portion of the recording medium 1 subsequent to the leading end portion in steps from S705 to S707. In some cases, however, it is difficult to satisfactorily decurl the curl in the leading end portion of the recording medium with one sequence for the reason that the curl is too large, or that the curl is too strong, or that the material of the recording medium is hard to correct the curl. In such a case, the sequence may be modified to repeatedly execute the curl correction on the leading end portion of the recording medium 1 plural times through steps from S701 to S703, and then to correct the curl in the other entire portion of the recording medium 1 subsequent to the leading end portion in steps S705 to S707 through step S701. Stated another way, the curl correction method may be executed such that, after repeating the above-described first to third steps plural times, the curl correction is performed on the other portion of the recording medium 1 subsequent to the leading end portion, which is conveyed in the direction for recording through step S701, while the recording medium 1 is curved with the aid of the decurl roller 9.

Further, the effect of correcting the curl in the leading end portion of the recording medium 1 may be enhanced by a method of increasing the extent of curving in the state of FIG. 5B, such as by increasing a range (center angle) over which the recording medium 1 is pressed against the decurl roller 9 by the decurl pinch roller 11, or by adjusting a pressing force. In some cases, the curl in the other portion of the recording medium 1 subsequent to the leading end portion may be corrected by continuously conveying the recording medium in the same state as that in step S705 without moving the decurl roller 9 in step S706.

Figure 7A:
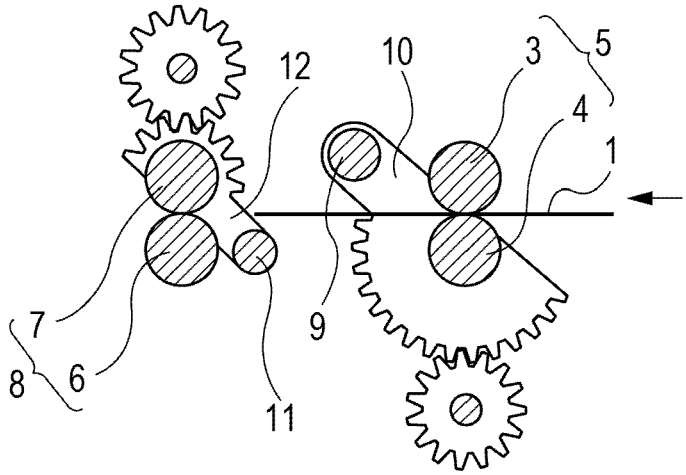
FIGS. 7A and 7B illustrate the curl correction mechanism according to one embodiment; specifically.
Figure 7B:
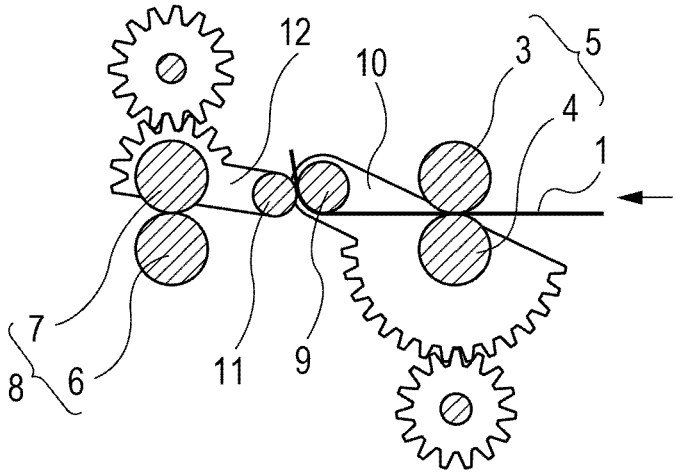

FIG. 7A is a vertical sectional view when the leading end portion of the recording medium is conveyed in the curl correction mechanism 30 to a position where the curl correction is performed in a direction opposite to that in the case of FIG. 5B. FIG. 7B is a vertical sectional view when curl is corrected in the curl correction mechanism 30 by curving the leading end portion of the recording medium in the direction reversal to that in the case of FIG. 5B. While the curl correction is performed in FIGS. 5A and 5B by curving the leading end portion of the recording medium downward, the curl correction mechanism 30 can also be used to perform the curl correction by curving the leading end portion of the recording medium upward as illustrated in FIGS. 7A and 7B.

In FIG. 7A, the leading end portion of the recording medium 1 is gripped between the pair of paper feed rollers 5 and is conveyed toward the pair of conveying rollers 8 by rotating the paper-feed driving roller 3 forward. At that time, the decurl roller 9 and the decurl pinch roller 11 are retracted from the intended conveyance path of the leading end of the recording medium 1. The retracted positions of the decurl roller 9 and the decurl pinch roller 11 are located on the side opposed to those in the state of FIG. 5A with respect to the recording medium 1. Then, the curl correction mechanism 30 is operated from the state of FIG. 7A to a state of FIG. 7B. More specifically, the leading end portion of the recording medium 1 is gripped between the decurl roller 9 and the decurl pinch roller 11 in the state where the leading end portion is curved upward, by moving the decurl roller 9 to a predetermined position and bringing the decurl pinch roller 11 into contact with the recording medium 1 from below.

In that state, the positions of the rollers 9 and 11 are located above the intended conveyance path of the recording medium 1. Namely, the positions of the rollers 9 and 11 are reversed from those in the state of FIG. 5B with respect to the recording medium 1 as viewed in the vertical direction. Therefore, the direction in which the leading end portion of the recording medium 1 is curved can be reversed and the curl correction can be performed by curving only the leading end portion in a direction reversal to that in the state of FIG. 5B. Thus, with the curl correction mechanism 30 according to the embodiment, the curl correction method can be realized which can reverse, in the second step executed in step S702 of FIG. 6, the direction in which the leading end portion of the recording medium 1 is curved.

According to the embodiment described above, the method of correcting curl of the recording medium and the recording apparatus are provided which can correct curl in the leading end portion of the recording medium without reducing the performance in conveying the recording medium. Also, the method of correcting curl of the recording medium and the recording apparatus are provided which can correct not only curl in the leading end portion of the recording medium in a dedicated manner, but also curl of the entire recording medium with relatively simple construction. Further, the curl in the leading end portion of the recording medium can be corrected while the curl correction conditions, such as the extent of forced curving and the curving direction, are changed to different ones from those set for the other portion of the recording medium than the leading end portion. The curl correction can therefore be easily performed in a dedicated manner suitable for the property of the leading end portion of the recording medium. As a result, the recording apparatus is provided in which the distance between the recording head and the recording medium (i.e., the head-to-paper distance) in the recording section can be easily and properly managed, and the recording medium can be conveyed to the pair of conveying rollers in a conveying section without problems.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A method of correcting curl of a sheet, the method comprising:

a first step of conveying the sheet in a conveying direction, thereby feeding a leading end portion of the sheet to a position between a decurl roller and a decurl pinch roller, which are in positions spaced apart from each other;

a second step of winding the leading end portion of the sheet over the decurl roller by the decurl pinch roller and the decurl roller;

a third step of conveying the sheet in a backward direction; and a step of, after executing the first to third steps, conveying the sheet in the conveying direction.

2. The method of correcting curl of the sheet according to claim 1, wherein after repeatedly executing the first to third steps plural times, the sheet is conveyed in the conveying direction through the first step while the sheet is curved by the decurl roller.

3. The method of correcting curl of the sheet according to claim 1, wherein a direction in which the leading end portion of the sheet is curved in the second step is reversed.

4. The method of correcting curl of the sheet according to claim 1, wherein an extent of curving applied by the decurl roller is changed between the leading end portion of the sheet and other portion of the sheet subsequent to the leading end portion.

5. A recording apparatus configured to record an image on a sheet by using a recording head, wherein the recording apparatus carries out the method of correcting curl of the sheet according to claim 1.

6. The recording apparatus according to claim 5, wherein the recording apparatus is an ink jet recording apparatus in which an image is recorded by discharging ink to the sheet from the recording head.

7. A curl correction apparatus comprising:

a conveying unit configured to convey a sheet;

a decurl roller arranged downstream of the conveying unit in a conveying direction;

a decurl pinch roller configured to curve and hold the sheet in cooperation with the decurl roller; and a control unit configured to control such that the sheet is conveyed in the conveying direction, thereby feeding a leading end portion of the sheet to a position between a decurl roller and a decurl pinch roller, which are in positions spaced apart from each other, then winding the leading end portion of the sheet over the decurl roller by the decurl pinch roller and the decurl roller, then conveying the sheet in a backward direction, and then conveying the sheet in the conveying direction.

8. A recording apparatus comprising:

a curl correction apparatus which includes:

a conveying unit configured to convey a sheet;

a decurl roller arranged downstream of the conveying unit in a conveying direction;

a decurl pinch roller configured to curve and hold the sheet in cooperation with the decurl roller; and a control unit configured to control such that the sheet is conveyed in the conveying direction, thereby feeding a leading end portion of the sheet to a position between a decurl roller and a decurl pinch roller, which are in positions spaced apart from each other, then winding the leading end portion of the sheet over the decurl roller by the decurl pinch roller and the decurl roller, then conveying the sheet in a backward direction, and then conveying the sheet in the conveying direction; and a recording unit arranged downstream of the curl correction apparatus in the conveying direction for recording an image on the sheet conveyed by the conveying unit.

* * * * *